United States Patent [19]

Moser

[11] Patent Number: 4,724,639

[45] Date of Patent: Feb. 16, 1988

[54] PRESTRESSING ANCHOR ARRANGEMENT

[75] Inventor: Niklaus G. Moser, Spiez, Switzerland

[73] Assignee: VSL International AG, Bern, Switzerland

[21] Appl. No.: 816,229

[22] Filed: Jan. 6, 1986

[30] Foreign Application Priority Data

Jan. 17, 1985 [CH] Switzerland ..... 216/85

[51] Int. Cl.[4] ..... E04C 5/08

[52] U.S. Cl. ..... 52/223 L; 52/741; 29/452; 264/229

[58] Field of Search ..... 264/228, 229; 52/223 R, 52/223 L, 224, 228, 230, 741; 29/452; 249/40–43, 210, 213, 217; 24/122.6, 136 R, 115 M

[56] References Cited

U.S. PATENT DOCUMENTS

| | | | |
|---|---|---|---|
| 2,180,866 | 11/1939 | Cryer | 403/369 |
| 3,033,600 | 5/1962 | Drysdale | 403/274 |
| 3,573,346 | 4/1971 | Appleby | 174/71 R |
| 3,590,474 | 7/1971 | Beghi | 29/452 |
| 3,844,697 | 10/1974 | Edwards | 425/111 |
| 4,307,550 | 12/1981 | Behar | 52/223 L |
| 4,368,607 | 1/1983 | Boonman | 52/741 |

FOREIGN PATENT DOCUMENTS

| | | | |
|---|---|---|---|
| 295542 | 2/1968 | Australia | 24/115 M |
| 208349 | 1/1908 | Fed. Rep. of Germany | 24/115 M |
| 522510 | 4/1931 | Fed. Rep. of Germany | 52/223 R |
| 1097114 | 1/1961 | Fed. Rep. of Germany | 52/223 L |
| 1143319 | 8/1963 | Fed. Rep. of Germany | 52/223 L |
| 1814988 | 10/1969 | Fed. Rep. of Germany | 52/230 |
| 1526738 | 5/1968 | France | 52/223 L |
| 1216923 | 12/1970 | United Kingdom | 52/223 L |
| 2078814A | 1/1982 | United Kingdom | 52/223 R |

*Primary Examiner*—John E. Murtagh
*Assistant Examiner*—Andrew J. Rudy
*Attorney, Agent, or Firm*—Oldham, Oldham & Weber Co.

[57] ABSTRACT

A prestressing anchor is embedded in concrete in part of a concrete structural component, and after setting of the concrete, a prestressing element extending through the prestressing anchor is prestressed and held by clamping wedges disposed in a frustoconical portion of a passage running through the prestressing anchor. Thereafter, a spacer element and an associated or integral further prestressing anchor provided with clamping wedges are pulled onto the prestressing element. With the aid of screws passing through flanges of the prestressing anchors, the further prestressing anchor is held to the first prestressing anchor, the spacer element resting snugly against the end faces of the clamping wedges. The second phase of construction is then carried out, at which time the further prestressing anchor is also embedded in concrete. After setting of the concrete, the following section of the prestressing element is prestressed to about the same value as the preceding section. In this intermediate anchor arrangement, only the clamping wedges of the prestressing anchor first embedded in concrete exert their full clamping action upon the prestressing element, whereas the clamping wedges of the further prestressing anchor exert only a slight clamping action. If the prestressing in the following section suddenly gives way in the event of trouble, the prestressing in the preceding section is maintained thanks to the clamping wedges in the prestressing anchor first embedded in concrete. In case of sudden release of the prestressing in the preceding section, the clamping wedges of the prestressing anchor first embedded in concrete are pulled out of the latter, this movement of displacement being transferred by the spacer element to the clamping wedges of the further prestressing anchor. The clamping wedges of the further prestressing anchor are thereby brought into their clamping position, and the prestressing in the following section of the prestressing element is maintained.

8 Claims, 7 Drawing Figures

PRESTRESSING ANCHOR ARRANGEMENT

Figure 1:
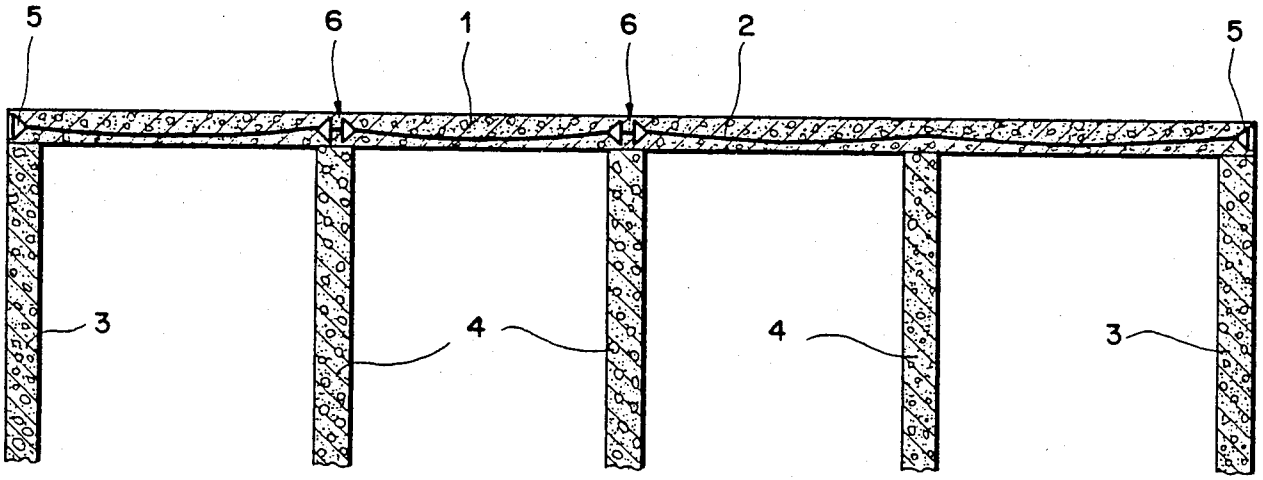

This invention relates to prestresses concrete construction, and more particularly to an intermediate anchor arrangement for prestressing structural components, especially concrete ceilings produced in several phases of construction, by means of at least one prestressing element extending through the structural members, of the type having two prestressing anchors with at least two clamping wedges each and screws for holding the two prestressing anchors together after carrying out the preceding phase of construction and during the following phase of construction.

The present invention further relates to a method of producing such an intermediate anchor arrangement, of the type wherein the first prestressing anchor of the arrangement is embedded in concrete during the preceding phase of construction and the respective section of the prestressing element is prestressed after the concrete has set.

In concrete construction, so-called "prestressing with subsequent bonding" is used, where the prestressing elements are longitudinally movable within encasing tubes and are tensioned after the concrete has set. The space subsisting in the tubes is then filled with injected material. In this way, bonding is achieved over the entire length of the prestressing elements between them and the surrounding concrete, which gives added security both in the event of rupture and upon failure of an anchorage.

Besides the aforementioned "prestressing with subsequent bonding," a "prestressing without bonding" has been increasingly used for concrete ceilings and other concrete structures in recent times. In this latter type of construction, the prestressing element is prevented from coming directly in contact with the concrete. The prestressing element, surrounded by a layer of slushing grease, is situated in a plastic tube. After the concrete has set, the prestressing elements are tensioned, without any bonding to the surrounding concrete over the entire length between the two anchorages.

In such structures, especially in the case of long prestressing elements passing through a number of ceiling sections, it is a disadvantage if, upon local destruction of one ceiling section, those directly adjacent can also be affected under certain circumstances.

It may also happen that if one anchorage location of a single prestressing element fails, the remaining, intact prestressing elements must compensate for the lost prestressing force of that single prestressing element, and this will necessarily lead to a reduction of the resistance to rupture of such a part of the structure.

It has therefore been sought to incorporate by means of additional intermediate anchorages, preferably situated in the vicinity of supports, added reserves which become effective upon failure of one of the end anchorages, so that only some of the ceiling sections are damaged.

Another advantage of such intermediate anchorages is that proportionate to the decrease in extension length of the prestressing elements, the build-up of stress, and hence the breaking strength, is increased accordingly.

German Pat. No. 1,143,319 describes an intermediate anchorage called a prestressing element joint, wherein two adjacent prestressing anchors are secured to one another by means of threaded bolts prior to concreting in the second phase of construction. The two prestressing anchors are pressed against one another by the bolts with at least the prestressing force of the prestressing element. Consequently, when the high-strength screws are tightened, the clamping wedges and the wires of the still-unstressed prestressing elements are pressed into the anchor cone with at least the full prestressing force, so that when these elements are put under tension, no more slipping occurs, and the tensioned high-strength screws are substantially not further elongated. This prior art intermediate anchorage has several drawbacks: high-strength threaded bolts must be used, which together must withstand the tension force of the prestressing element; tightening of the nuts screwed on the bolts requires great skill and must be carried out very carefully since at least four high-strength screws must be tensioned simultaneously; and finally, because of the non-prestressed portion of the prestressing element in the region of the expansion joint, no prestressing is exerted upon the concrete there. This means that precisely the part of the structure in the region of the joint is in danger of cracking during use and must be treated according to other statics criteria than "prestressed concrete without bonding."

U.S. Pat. No. 4,368,607 describes an intermediate anchorage having two prestressing anchors with appurtenant clamping wedges. Associated with the clamping wedges of each prestressing anchor is an operating member having a pipe piece surrounding the prestressing element and a hub surrounding the thicker ends of the wedges, as well as part of the prestressing anchor. The pipe pieces are threaded on the outside, and a tubular compression member provided with oppositely directed internal threads is screwed on these outside threads of the opposing pipe pieces of the operating members. The middle part of the compression member is hexagonal so that this member can be rotated about its longitudinal axis with the aid of a wrench, whereby the operating members are pressed apart, and the clamping wedges are pressed into the frustoconical recesses in the prestressing anchors. This prior art intermediate anchor arrangement is packed as a whole in polystyrene foam between the two anchor plates and thus forms a rectangular plastic clearance block, the operating member being in a position in which the clamping wedges project only partially into the furstoconical recess and which makes it possible to thread in the individual prestressing elements subsequently.

For constructing, say, a concrete ceiling extending over a number of sections, the plastic foam clearance block is preferably disposed over the supports. Conventional prestressing anchors are set at the two ends of the prestressing element, and the whole ceiling is then concreted. After the concrete has set, the foam material surrounding the intermediate anchor arrangements is removed so that the compression members are accessible. The prestressing elements are then tensioned over their entire length in a manner known per se. After that, the compression member of each intermediate anchor arrangement is operated in such a way that the clamping wedges are pressed into the frustoconical recesses of the prestressing anchors, and the respective region of the prestressing element is thereby clamped fast in the prestressing anchors, so that the prestressing element can no longer be displaced longitudinally. Finally, the clearance spaces left free when the polystyrene foam is removed are filled with concrete.

With the intermediate anchor arrangement described above, the plastic foam must be removed after the concrete has set; and once the compression members have been securely tightened, the resultant hollow spaces in the concrete must be filled up again, which involves considerable extra work. The compression members must be tightened very carefully because if they are not tightened sufficiently, the clamping effect is not strong enough, and the intermediate anchor arrangement is not effective.

Another disadvantage is that the hollow spaces in the concrete are not filled up with concrete until the prestressing operations are terminated and thereby form places which are not prestressed.

It is an object of this invention to provide an improved intermediate anchor arrangement for prestressing structural components which does not have the aforementioned shortcomings and which can be utilized without problems.

A further object of this invention is to provide a method of producing such an anchor arrangement.

To this end, in the anchor arrangement according to the present invention, of the type initially mentioned, the improvement comprises rigid means for holding the clamping wedges of the two prestressing anchors spaced from one another, this spacing being such that only the clamping wedges of one of the prestressing anchors is in a position in which it can exert its full clamping action.

In the method according to the present invention, likewise of the type initially mentioned, the second prestressing anchor through which the prestressing element passes is secured by means of screws to the first prestressing anchor embedded in concrete in such a way that the clamping wedges of the two prestressing anchors rest against the spacing means, the screws are tightened only so far that the second prestressing anchor remains stationary during concreting of the following phase of construction and the clamping wedges of the second prestressing anchor are in the starting phase of their clamping position, and after setting of the concrete poured during the following phase of construction, the associated section of the prestressing element is prestressed like the preceding section during the preceding phase of construction.

Figure 2:
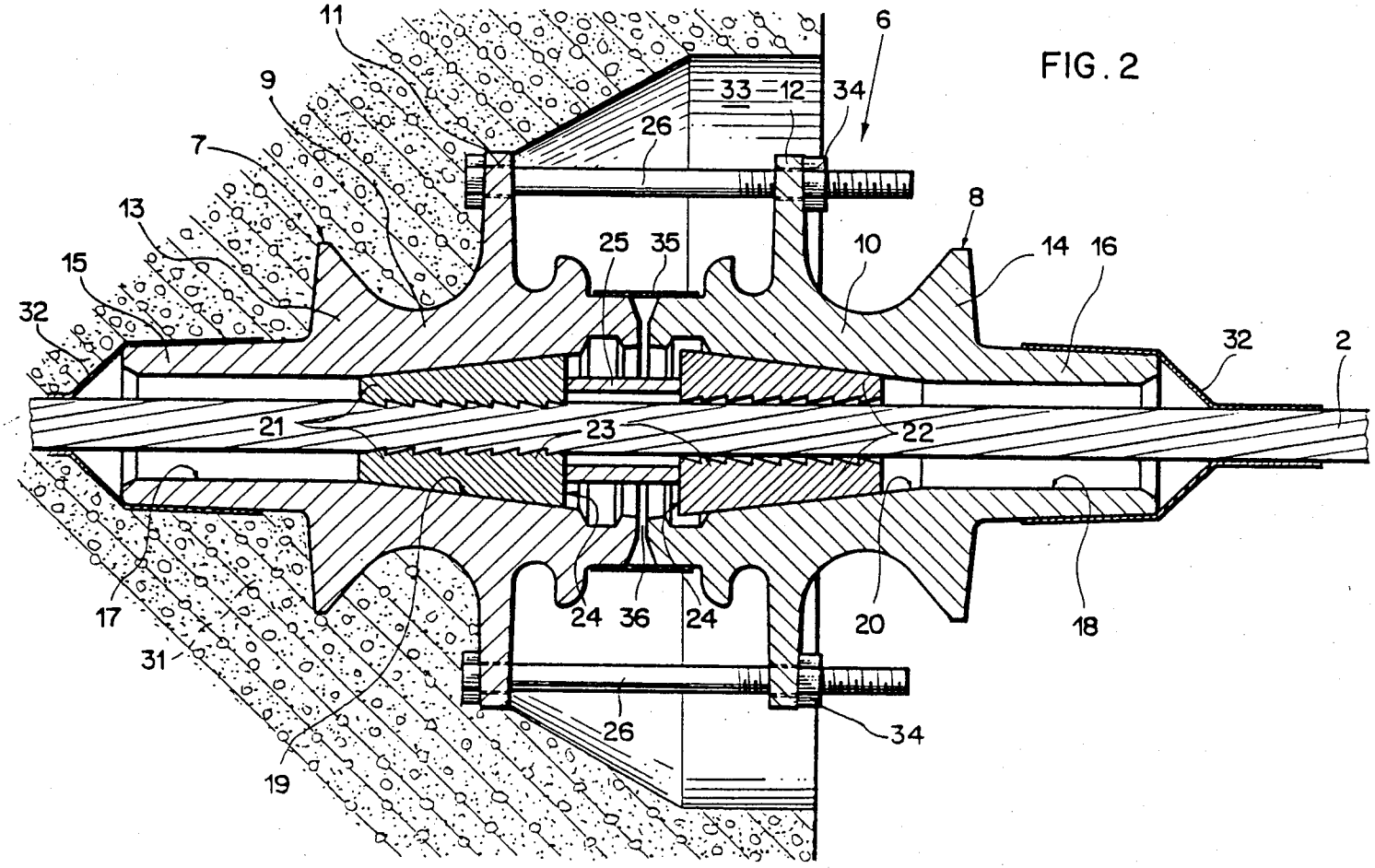
Figure 3:
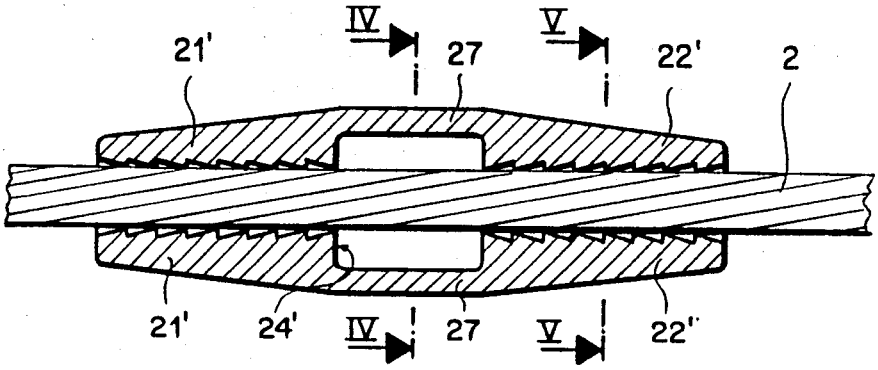
Figure 4:
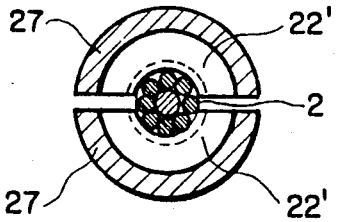
Figure 5:
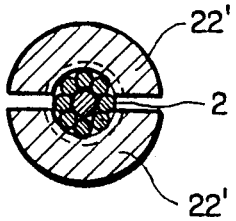
Figure 6:
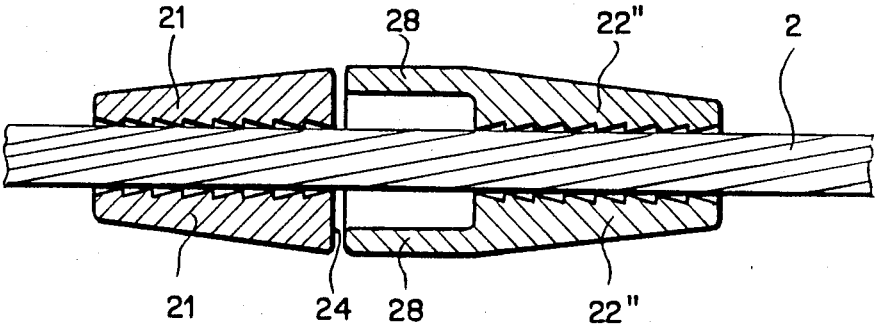
Figure 7:
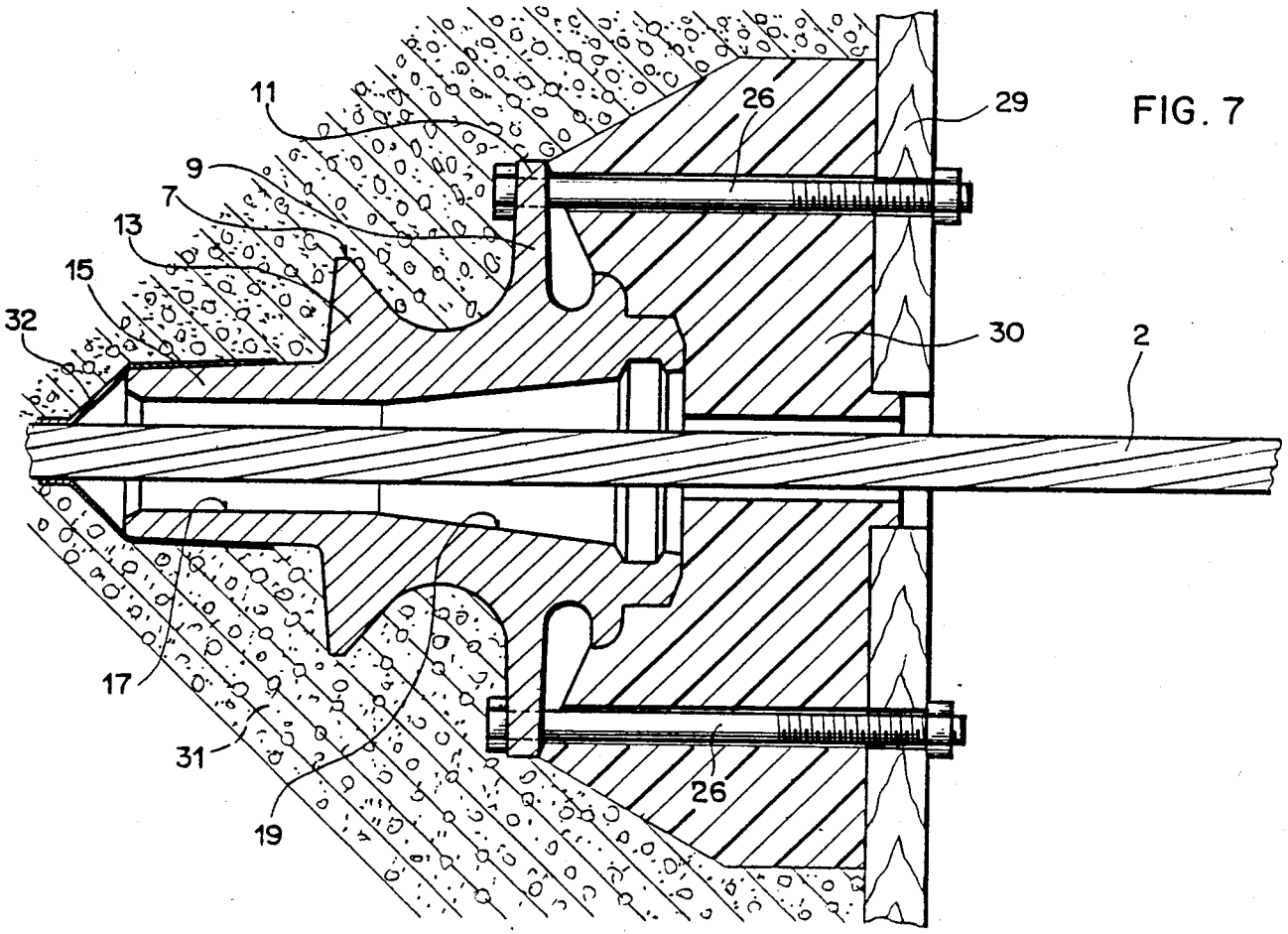

Preferred embodiments of the invention will now be described in detail with reference to the accompanying drawings, in which:

FIG. 1 is a greatly simplified representation of a concrete ceiling in cross-section, FIG. 2 is a longitudinal section through a first embodiment of the intermediate anchor arrangement according to this invention, one of the prestressing anchors already being embedded in concrete, FIG. 3 is a longitudinal section through clamping wedges of the arrangement of FIG. 2, with spacing means according to a second embodiment, FIG. 4 is a section taken on the line IV—IV of FIG. 3, FIG. 5 is a section taken on the line V—V of FIG. 3, FIG. 6 is a longitudinal section through clamping wedges of the arrangement of FIG. 2, with spacing means according to a third embodiment, and FIG. 7 is a section through one of the prestressing anchors of the intermediate anchor arrangement in a preparatory stage after concreting in a preceding phase of construction.

FIG. 1 shows a structural member, specifically a concrete ceiling 1, in a greatly simplified sectional view so that one of the prestressing elements 2 extending through ceiling 1 is visible. The ends of ceiling 1 are supported by outside walls 3 shown only partially. Between the walls 3, there are pillars 4, metal supports, or partitions upon which ceiling 1 is additionally supported. At each end of prestressing element 2, which may be a tension cable of steel wires, for example, there is an end prestressing anchor 5. In order to prevent the stressing force from being lost over the whole length of prestressing element 2 in case one of the end prestressing anchors 5 should loosen or if prestressing element 2 should break, so-called intermediate anchor arrangements 6 are disposed preferably in the areas above pillars 4. The invention to be described below relates to the design and production of such an intermediate anchor arrangement 6.

FIG. 2 is a longitudinal section through one embodiment of such an intermediate anchor arrangement 6, comprising two prestressing anchors 7 and 8 which, singly, may also be used as the aforementioned end prestressing anchors 5 at each end of prestressing element 2. Each prestressing anchor has a supporting body 9, 10 including a flange 11, 12 projecting radially outward and a likewise outwardly projecting support rib 13, 14, adjoining which is a cylindrical extension 15, 16. Through each body 9, 10 there extends a passage for prestressing element 2 consisting of a cylindrical portion 17, 18 in the region of extension 15, 16 and a frustoconical portion 19, 20. Frustoconical portions 19 and 20 are intended to receive, say, two clamping wedges 21 and two clamping wedges 22, respectively. Clamping wedges 21 and 22 are provided on the inside with sawtooth ribs 23 which, when the clamping wedges are brought into operative position, penetrate at least partially into prestressing element 2 in order to hold it fast.

Between the large end faces 24 of clamping wedges 21 and 22 there is a rigid tubular element 25, e.g., a pipe piece. The inside diameter of tubular element 25 is larger than the outside diameter of prestressing element 2 so that the latter can move freely within the former. Screws 26, e.g., four in number, extend through bores distributed regularly around the peripheries of flanges 11 and 12. The purpose of screws 26 will be explained below.

FIG. 3 shows only part of prestressing element 2 and clamping wedges 21′ and 22′ of the intermediate anchor arrangement. Clamping wedges 21′ and 22′ are rigidly connected to one another by means of bridging portions 27 which perform the function of the above-mentioned tubular element 25. FIG. 4 is a section through bridging portion 27, and FIG. 5 a section through clamping wedges 22′. Portion 27 is so arranged as not to touch prestressing element 2 when assembled.

FIG. 6 also shows only prestressing element 2 and clamping wedges 21 and 22″ of the intermediate anchor arrangement. Clamping wedges 21 are the same as those illustrated in FIG. 2. Clamping wedges 22″, on the other hand, each include an extension 28, the free ends of which are intended to rest against the end faces 24 of clamping wedges 21. Extensions 28 are so arranged as not to touch prestressing element 2 when the clamping wedges are assembled. This embodiment is the most advantageous of the three thus far described as regards the means for holding the clamping wedges spaced at a given distance from one another.

FIG. 7 is a sectional view of part of the intermediate anchor arrangement according to this invention after concreting in a preceding phase of construction. Prior to such concreting, prestressing element 2 was pushed through prestressing anchor 7, and the latter was secured by means of screws 26 to a form board 29, shown only in part, prestressing anchor 7 being held spaced from board 29 by means of a filler 30, e.g., of foamed plastic. The concrete poured during the first phase of construction is designated by reference numeral 31.

Since the intermediate anchor arrangement described above is used for producing structural components such as concrete ceilings, floor slabs, runways, bridge members, etc., with "prestressing without bonding," the sections of prestressing element 2 extending through the concrete are enclosed in a protective sheath or tube (not shown). In order to prevent the concrete from penetrating inside prestressing anchor 7, a sleeve 32 is provided to form a protective transition part between the end of the aforementioned sheath or tube and cylindrical extension 15.

After the concrete 31 has set, form board 20 and filler 30 are removed. The latter leaves a recess (see FIG. 2) into which part of prestressing anchor 7 projects. Clamping wedges 21 are then inserted in the frustoconical portion 19 of the passage through prestressing anchor 7, and the section of prestressing element 2 extending through the set concrete 31 is prestressed to the prescribed value by means of a prestressing device known per se and therefore not further described here. After prestressing, clamping wedges 21 assume within prestressing anchor 7 the position shown in FIG. 2 and prevent the respective section of prestressing element 2 from relaxing.

Next tubular element 25 is slipped over prestressing element 2, then prestressing anchor 18, initially without clamping wedges 22, until tubular element 25 rests against end faces 24 of clamping wedges 21. Now clamping wedges 22 are inserted into frustoconical portion 20 of the passage through prestressing anchor 8, and the latter is pushed toward prestressing anchor 7, already embedded in concrete, until end faces 24 of clamping wedges 22 rest against tubular element 25 and screws 26 pass through flange 12 of prestressing anchor 8. By means of nuts 34 screwed onto the ends of screws 26 and tightened only moderately, prestressing anchor 8 is held coaxial with prestressing anchor 7. Nuts 34 are tightened only to the extent that all clamping wedges 21 and 22 rest snugly against tubular element 25, that clamping wedges 22 are not pushed completely into frustoconical portion 20 of the passage through prestressing anchor 8, and that only a very slight clamping effect is thus exerted upon prestressing element 2. This condition is illustrated in FIG. 2.

After a further sleeve 32 has been placed on the end of extension 16 of prestressing anchor 8 and anticorrosive tape 35 has been wrapped around the gap 36 between prestressing anchors 7 and 8, the concrete for the next phase of construction is poured, at which time recess 33 is also filled with concrete. Anticorrosive tape 35 prevents concrete from penetrating into the space between clamping wedges 21 and 22.

After setting of the concrete poured in this next phase of construction, the respective section of prestressing element 2 is prestressed to the prescribed value mentioned above. At the end of this section, an end prestressing anchor 5 or the prestressing anchor 7 of a succeeding intermediate anchor arrangement may be disposed. Because clamping wedges 22 of prestressing anchor 8 exert virtually no clamping action upon prestressing element 2, the prestressing of the second section of prestressing element 2 takes effect all the way to the part of prestressing element 2 gripped by clamping wedges 21, whereby prestressing element 2 is prestressed substantially uniformly over its entire length, regardless of the number of intermediate anchor arrangements existing between the end locations of prestressing element 2.

Even after prestressing of the succeeding section of prestressing element 2, prestressing anchors 7 and 8, as well as their associated clamping wedges, remain in the position illustrated in FIG. 2, i.e., clamping wedges 21 of prestressing anchor 7 exert their full clamping action upon prestressing element 2, whereas clamping wedges 22 of prestressing anchor 8 exert almost no clamping action upon prestressing element 2.

A significant advantage of the intermediate anchor arrangement described above is that element 2 can be substantially uniformly prestressed throughout, i.e., even in the vicinity of the intermediate anchorages.

If prestressing anchor 5 at the other end of the first section of prestressing element 2 should suddenly come loose, or if the prestressing element should snap in the first section, clamping wedges 21 of prestressing anchor 7 will be pulled to the right, as viewed in FIG. 2, by the prestressing in the remaining portion of prestressing element 2. This movement will instantaneously be transmitted via tubular element 25 to clamping wedges 22 of prestressing anchor 8, whereby clamping wedges 22 will necessarily be urged into their operative position, i.e., they will be pushed completely into the frustoconical portion 20 of the passage in prestressing anchor 8. Hence the clamping action of clamping wedges 21 will be transmitted to clamping wedges 22.

Should the anchorage in the following section let go, the prestressing in the preceding section of prestressing element 2 will be maintained by clamping wedges 21 of prestressing anchor 7, which are already in clamping position.

As already mentioned with reference to FIGS. 3 and 6, clamping wedges 21′ and 22′, rigidly interconnected by bridging portion 27, may be used instead of clamping wedges 21 and 22 and tubular element 25; or, preferably, clamping wedges 21 and 22″ may be utilized, clamping wedges 22″ including extension 28. This last embodiment of the spacing means is particularly advantageous because it is easier to assemble as compared with the tubular spacing means.

The intermediate anchor arrangement described above is effective even in the event of trouble, such as when a degree of tension in excess of the prescribed value is applied to prestressing element 2 during a succeeding phase of construction. In this case, it may be that clamping wedges 21 of prestressing anchor 7 move a little to the right, as viewed in FIG. 2, thus reducing the clamping effect of clamping wedges 21. However, tubular element 25 transfers the displacement of clamping wedges 21 to clamping wedges 22 in such a way that the clamping action of clamping wedges 22 increases to the extent that that of clamping wedges 21 decreases. As a side effect, prestressing element 2 is in turn uniformly subjected to tension over its entire length. If a defect should occur to one side or the other of the intermediate anchor arrangement, the clamping wedges will react in the same way as described above, i.e., in the event of trouble, those clamping wedges facing the affected area are always automatically brought into their fully operative position.

Because the purpose of screws 26 is to hold form board 29 while prestressing anchor 7 is being embedded in concrete, to hold prestressing anchor 8 during assembly, and to cause tubular element 25 or extension 28 to lie snugly against the end faces of the clamping wedges, they are not subjected to any great load and may therefore be ordinary screws.

What is claimed is:

1. In an intermediate anchor arrangement for prestressing concrete structural members by means of at least one prestressing element extending through said structural members, said arrangement including two prestressing anchors, two clamping wedge assemblies, each comprising at least two clamping wedges, respectively associated with said two prestressing anchors, and two or more screws, the improvement comprising rigid spacing means for holding said clamping wedge assemblies spaced from one another to such an extent that only one of said two clamping wedge assemblies is situated in a position enabling it to exert full clamping action upon said prestressing element.

2. The intermediate anchor arrangement of claim 1, wherein said rigid spacing means is a rigid tubular element having a larger inside diameter than the outside diameter of said prestressing element, said tubular element being disposed between said two clamping wedge assemblies and surrounding said prestressing element.

3. The intermediate anchor arrangement of claim 1, wherein said rigid spacing means takes the form of at least two extensions respectively integral with said at least two clamping wedges of one of said clamping wedge assemblies, said extensions being spaced from said prestressing element.

4. The intermediate anchor arrangement of claim 1, wherein said rigid spacing means takes the form of one or more bridging portions rigidly connecting said clamping wedge assemblies and spaced from said prestressing element.

5. The intermediate anchor arrangement of claim 1, wherein each of said prestressing anchors includes a frustoconical recess for receiving said clamping wedges.

6. In an intermediate anchor arrangement as in claim 1 where said clamping wedges have base ends, said anchors position said clamping wedges in alignment but with their base ends adjacent, said spacing means contacting and extending between said base ends whereby any releasing movement of one of said clamping wedges produces a tightening movement of the other of said clamping wedges.

7. A method of producing an intermediate anchor arrangement for prestressing concrete structural components by means of at least one prestressing element extending through the components, comprising the steps of:

slipping over the prestressing element a first prestressing anchor having associated clamping wedges, embedding the first prestressing anchor in concrete during a first phase of construction, prestressing the portion of the prestressing element associated with the first prestressing anchor after setting of the concrete, slipping over the prestressing element a second prestressing anchor having associated clamping wedges with associated or integral spacing means, connecting the second prestressing anchor to the first prestressing anchor by means of screws in such a way that the spacing means are contiguous with the clamping wedges of both the first and second prestressing anchors, and tightening the screws only to the extent that the second prestressing anchor remains stationary during the phase of construction which follows and the clamping wedges of the second prestressing anchor exert only a slight clamping effect, embedding the second prestressing anchor in concrete, and prestressing the section of the prestressing element associated with the second prestressing anchor after setting of the concrete.

8. The method of claim 7, wherein each of said prestressing anchors includes a frustoconical recess for receiving said clamping wedges, and the clamping wedges associated with the second prestressing anchor are inserted loosely into the frustoconical recess in said anchor and are kept in that position during said phase on construction which follows said clamping wedges being aligned and oppositely directed, and adjusting the clamping effect of the second prestressing anchor by said screws.

* * * * *